US008137781B2

(12) United States Patent
Dangami

(10) Patent No.: US 8,137,781 B2
(45) **Date of Patent: *Mar. 20, 2012**

(54) INFORMATION SHEET

(75) Inventor: Akira Dangami, Tokyo (JP)

(73) Assignee: Lintec Corporation, Itabashi-ku (JP)

( * ) Notice: Subject to any disclaimer, the term of this patent is extended or adjusted under 35 U.S.C. 154(b) by 714 days.

This patent is subject to a terminal disclaimer.

(21) Appl. No.: 12/252,688

(22) Filed: Oct. 16, 2008

(65) Prior Publication Data

US 2009/0110863 A1 Apr. 30, 2009

(30) Foreign Application Priority Data

Oct. 25, 2007 (JP) ..... 2007-277396

(51) Int. Cl.
*G09F 3/10* (2006.01)

(52) U.S. Cl. ..... 428/43; 53/460; 229/68.1; 428/48; 428/131

(58) Field of Classification Search ..... 53/460; 229/168.1, 68.1; 428/43, 48, 131
See application file for complete search history.

(56) References Cited

U.S. PATENT DOCUMENTS

2003/0222127 A1* 12/2003 Katz ..... 229/68.1

FOREIGN PATENT DOCUMENTS

| | | | |
|---|---|---|---|
| CN | 1405742 | A | 3/2003 |
| JP | 2002-067546 | A | 3/2002 |
| WO | 97/47465 | A1 | 12/1997 |

* cited by examiner

*Primary Examiner* — Brent Ohern
(74) *Attorney, Agent, or Firm* — Westerman, Hattori, Daniels & Adrian, LLP

(57) ABSTRACT

An information sheet is held between an adhesive sheet and an adherend, and is partitioned into a first and second sheet portion by a first perforated-line. When the second sheet portion is folded at the first perforated-line position and overlapped on the first sheet portion, the edge portion side of the first sheet portion is protruded a predetermined amount out of the edge border of the second sheet portion to form an adhesive margin. The adhesive margin and a contra mating surface of the second sheet portion are stuck to an adhesive layer of the adhesive sheet. Respective surfaces on the mating side of the first and second sheet portions are printed with confidential information capable of being cut off along the first and second perforated-lines.

10 Claims, 7 Drawing Sheets

INFORMATION SHEET

BACKGROUND OF THE INVENTION

1. Field of the Invention

The present invention relates to an information sheet to be applied to a delivery slip and the like, and more particularly to an information sheet which is held between an adhesive sheet and an adherend, and is capable of maintaining secrecy of information even when the adhesive sheet is peeled off from the adherend.

2. Related Art

Recently, with the universal spread of Internet shopping, TV shopping, and the like, mail-order sales have become popular in addition to traditional over-the-counter sales, and a distribution system by delivery companies to deliver products to consumers on behalf of sellers has been increasingly common. Consequently, leaks of information about the products such as the product name and price may be caused through the delivery slips. These information identify the products bought by the consumers, therefore such information are confidential information greatly concerning privacy of the consumers. Also from the perspective of discouraging theft during the course of distribution, they should be confidential information because the product value can be figured out from the product price.

As a delivery slip described above, an example is disclosed in the patent document 1. The delivery slip includes a duplicate sticking label which is positioned on the front surface of an adherend when attaching thereto; a receipt and a delivered label portions which are provided side by side with the duplicate sticking label; and an original sticking label; being arranged that an adhesive layer provided to the original sticking label and adhesive layers provided to the outer sides of the duplicate sticking label are to be stuck to the adherend in a state where the original sticking label is folded and positioned on the back surface side of the duplicate sticking label.

Patent Document 1: Japanese Patent Application Laid-Open No. 2002-67546

SUMMARY OF THE INVENTION

However, in the delivery slip disclosed in the patent document 1, it is arranged that the adhesive layer is provided on one surface of the original sticking label which is to be held between the duplicate sticking label and the adherend, and a release liner is temporarily stuck to the adhesive layer in its pre-use state. Accordingly, there is such a disadvantage that the delivery slip becomes not only troublesome to manufacture but also expensive in manufacturing cost.

Also, when the duplicate sticking label is peeled off from the adherend, contents printed on the receipt and the delivered label portions and the original sticking label become visible, therefore it is not capable of responding to when secrecy of information is required.

The present invention has been made in view of the above disadvantages, and its object is to provide an information sheet capable of forming by using common paper as a sheet to be held between an adhesive sheet and an adherend without having to carry out a special process, and also capable of maintaining secrecy of information securely.

In order to achieve the above object, the present invention adopts such an arrangement that an information sheet is stuck to an adhesive sheet to be held between the adhesive sheet and an adherend; and is capable of being exposed when the adhesive sheet is peeled off from the adherend, wherein a position a predetermined distance off the center of the sheet is set as a folding position so as to form a first and a second sheet portions partitioned by the folding position; and when the first sheet portion is folded and overlapped with the second sheet portion at the folding position, an edge portion side of the first sheet portion is protruded a predetermined amount out of an edge border of the second sheet portion to form an adhesive margin; and then the adhesive margin and a contra mating surface of the second sheet portion are formed to be stickable to the adhesive sheet.

And, the present invention adopts such an arrangement so as to achieve the above object as well as possible that an information sheet is stuck to an adhesive sheet to be held between the adhesive sheet and an adherend; and is capable of being exposed when the adhesive sheet is peeled off from the adherend, wherein a first perforated-line is formed at a position a predetermined distance off the center of the sheet so as to form a first and a second sheet portions partitioned by the first perforated-line; and when the first sheet portion is folded and overlapped with the second sheet portion along the first perforated-line, an edge portion side of the first sheet portion is protruded a predetermined amount out of an edge border of the second sheet portion to form an adhesive margin; and then the adhesive margin and a contra mating surface of the second sheet portion are formed to be stickable to the adhesive sheet.

Also, in the present invention, such an arrangement may be adopted that the first perforated-line is formed in the first sheet portion or at the folding position, and a second perforated-line is formed in the first sheet portion, so that the first sheet portion between the first perforated-line and the second perforated-line is formed to be capable of being cut off.

Further, it may be arranged that a sheet portion between the first perforated-line and the second perforated-line is provided with narrower-width portions so that the first sheet portion is not protruded out of the second sheet portion when the sheet is folded at the folding position.

Furthermore, it is preferable to adopt such an arrangement that the first perforated-line and/or the second perforated-line is formed in substantially parallel two rows mutually, and a cutting-off facilitating portion for the sheet portion between the two-row perforated-lines is formed at each edge portion of these perforated-lines.

Still further, at least one surface of mating surfaces of the first sheet portion and the second sheet portion and a contra mating surface of the first sheet portion may be formed as a printing surface.

Yet still further, such an arrangement is adopted that an information sheet is stuck to an adhesive sheet to be held between the adhesive sheet and an adherend; and is capable of being exposed when the adhesive sheet is peeled off from the adherend, wherein the information sheet is held by the adhesive sheet in a state of being folded and stuck to the adhesive sheet, and is provided with perforated-lines which allow for partial cutting-off when the adhesive sheet is peeled off from the adherend.

Additionally, in the present invention, "print letters" is used as a concept including characters, symbols, graphics, or their optional combinations. And, "folding position" may be either tangible, such as a perforated-line, pressed marks, prints (printed letters), or intangible without providing them. And also, "contra mating surface" means a surface on the reverse side the "mating surface".

According to the present invention, because the first and the second sheet portions which are partitioned by the folding position are lapped together, and a part of the first sheet portion protruded out of the second sheet portion is to be an adhesive margin, and then the adhesive margin and the contra mating surface of the second sheet portion are formed to be stickable to the adhesive sheet; by printing information on the mating surfaces of the first and the second sheet portions, the printed contents cannot be seen even when the adhesive sheet is peeled off from the adherend, thereby allowing to maintain secrecy thereof.

Also, the whole information sheet can be made up of common paper and the like without having to provide an adhesive layer, the manufacturing process can be extremely simplified and the manufacturing cost becomes inexpensive as well.

Further, according to the arrangement that the first and the second perforated-lines are provided, it becomes easy to cut off the sheet portion between the perforated-lines and file it.

Furthermore, according to the arrangement that the narrower-width portions are provided, the edges of the narrower-width portions are to be positioned within the surface of the second sheet portion, whereby the first sheet portion can be prevented from sticking to the adhesive layer and from becoming unable to be cut off.

Still further, according to the arrangement that the cutting-off facilitating portions are provided at the edge portions of the substantially parallel two-row perforated-lines, the sheet portion between the perforated-lines can be taken away as a cut tape, therefore, it becomes easy to cut off the sheet portion.

DETAILED DESCRIPTION OF THE PREFERRED EMBODIMENT

Hereinafter, an embodiment of the present invention will be described with reference to the accompanying drawings.

Figure 1:
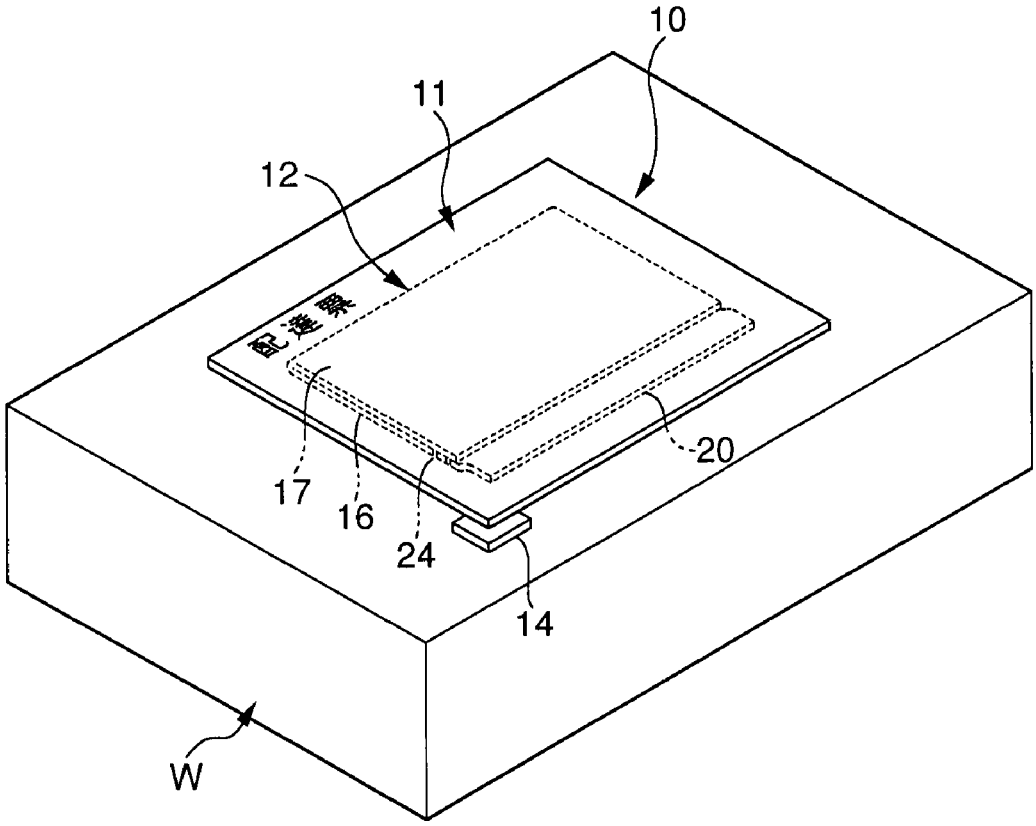
FIG. 1 is a perspective view schematically showing a usage state of a delivery slip according to an embodiment in which the delivery slip is stuck to an adherend.
Figure 2:
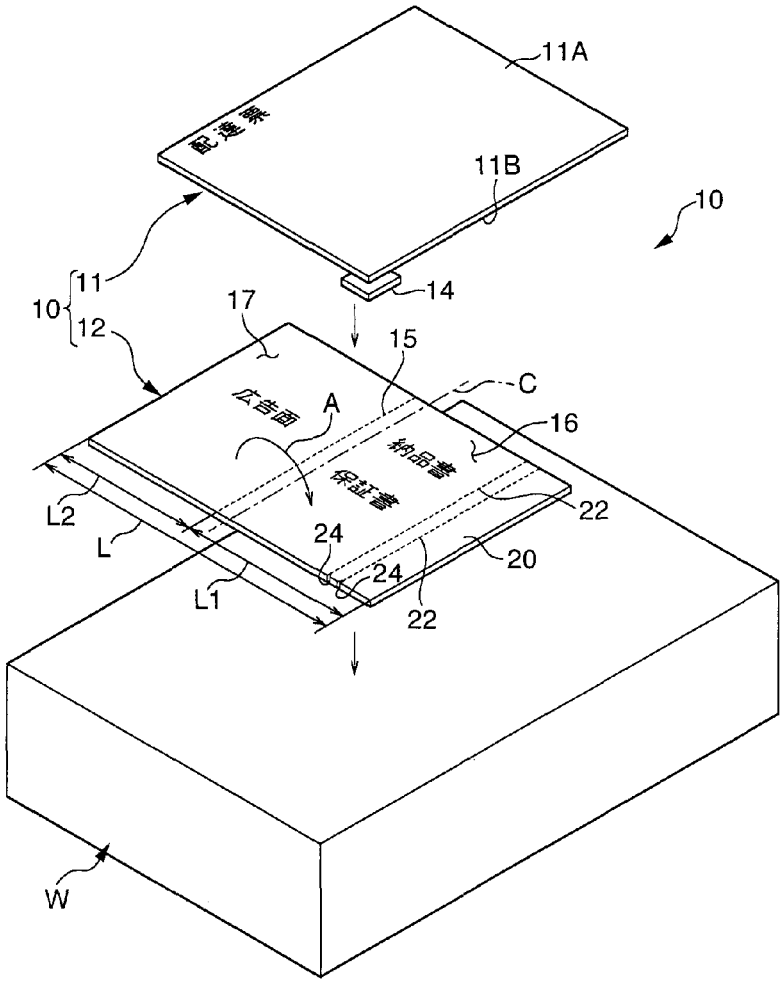
FIG. 2 is an exploded perspective view of FIG. 1.

FIG. 1 shows a schematic perspective view according to an embodiment in which an information sheet of the present invention is used as a part of a delivery slip, and FIG. 2 shows an exploded perspective view thereof. In these drawings, a delivery slip 10 which is stuck to an adherend W made up of a package case of a product via home-delivery and the like includes an adhesive sheet 11 and an information sheet 12 being held between the adhesive sheet 11 and the adherend W.

Figure 4:
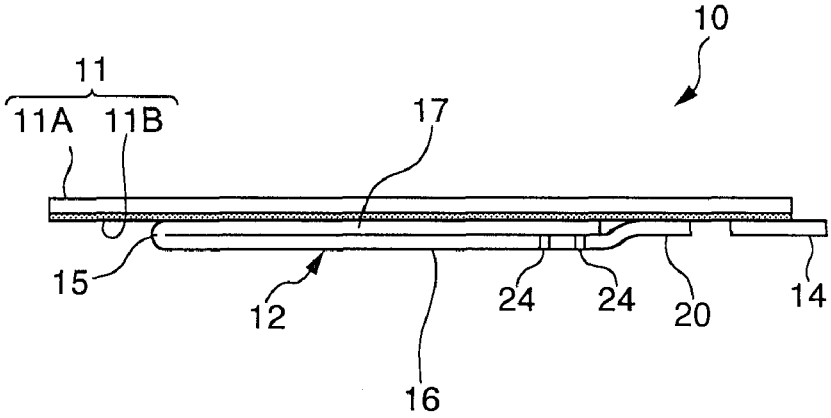
FIG. 4 is a side view of the delivery slip in which an information sheet is stuck to an adhesive sheet.

The adhesive sheet 11 is arranged using a sheet base 11A made up of paper or film having a substantially rectangular plane shape. The adhesive sheet 11 constitutes a delivery sheet, one surface of which, that is, the upper surface side in FIG. 1, is printed with delivery information such as destination address and name of a product via home-delivery, while the whole area of the other surface is, as shown in FIG. 4, provided with an adhesive layer 11B. And, a picking tab 14 for peeling-off is stuck to one corner of the adhesive sheet 11 so as to be protruding out of the edge thereof.

Figure 5:
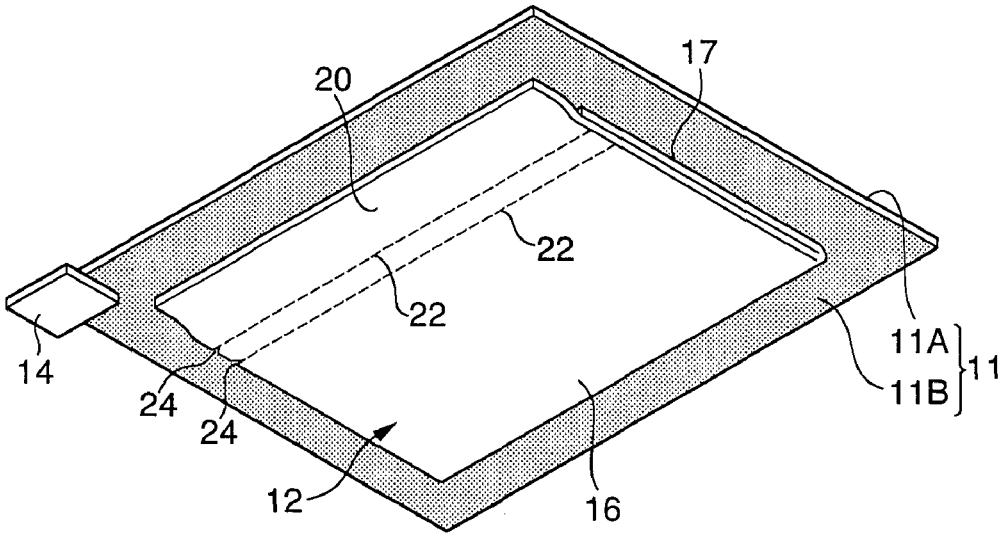
FIG. 5 is a perspective view of the delivery slip in FIG. 4 seen from the lower surface side.

The information sheet 12 is stuck with the adhesive sheet 11 to be held between the adhesive sheet 11 and the adherend W, and is exposably provided when the adhesive sheet 11 is peeled off from the adherend W. The information sheet 12 is made up of paper or film having a substantially rectangular plane shape, in which a first perforated-line 15 which functions as a folding position is formed at a position a predetermined distance off the center line C of its longitudinal length L, and is partitioned into a first sheet portion 16 and a second sheet portion 17 by the first perforated-line 15. Therefore, a length L1 of the first sheet portion 16 is to be longer than a length L2 of the second sheet portion 17 so that a part of the first sheet portion 16 is to be protruded out of an edge border of the second sheet portion 17 when the respective sheet portions 16 and 17 are folded at the first perforated-line 15 so as to be lapped together, and then the protruded portion of the sheet is to form an adhesive margin 20 (refer to FIG. 4). And, the planar size of the information sheet 12 in a state where the first sheet portion 16 and the second sheet portion 17 are lapped together is set to be smaller than that of the adhesive sheet 11 so that the adhesive layer 11B of the adhesive sheet 11 is to be exposed outside the periphery of the information sheet 12 like a closed loop when the information sheet 12 is stuck to the adhesive sheet 11 (refer to FIG. 5).

Figure 3:
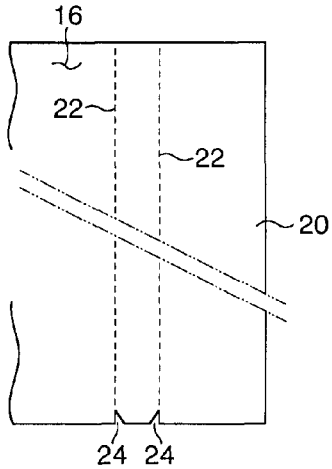
FIG. 3 is a partially enlarged plan view of a first sheet portion.

In the first sheet portion 16, second perforated-lines 22 are formed in two rows in a substantially parallel state mutually at a predetermined interval along the edge border of the second sheet portion 17 when the first sheet portion 16 is overlapped with the second sheet portion 17. These second perforated-lines 22 are formed to be positioned on the inward side of the edge border of the second sheet portion 17 when the first and the second sheet portions 16 and 17 are folded along the first perforated-line 15. Here, as shown in FIG. 3, substantially V-notch-shaped cutout portions 24, which make up cutting-off facilitating portions, are formed at one edge portion of the second perforated-lines 22, and a sheet portion between the perforated-lines 22 can be cut off in a similar manner to a cut-tape by an operation of picking and pulling off the edge border between the cutout portions 24.

In the embodiment, the mating surfaces of the first sheet portion 16 and the second sheet portion 17 and the contra mating surface of the first sheet portion 16 are formed as printing surfaces. The surface on the mating side of the first sheet portion 16 and the contra mating surface of the first sheet portion 16 are printed with contents equivalent to an invoice form and a guarantee form so as to be cut off from the adhesive sheet 11 for filing them, while the surface on the mating side of the second sheet portion 17 is typed or printed with advertisements not particularly needing to be filed, and information not requiring secrecy, such as campaign information, a commercial message, an informational message, a description about cooling-off.

To attach the delivery slip 10 to the adherend W, as shown in FIG. 2, fold the second sheet portion 17 in the direction indicated with an arrow A at the first perforated-line 15 as the folding position, and overlap on the first sheet portion 16; thereby becoming in a state where the contents printed on the mating surfaces of the first and the second sheet portions 16 and 17 are lapped together, and an edge portion of the first sheet portion 16 is protruded out of the edge border of the second sheet portion 17 as the adhesive margin 20.

Then, attach the contra mating surface of the second sheet portion 17 and the adhesive margin 20 to the adhesive layer 11B of the adhesive sheet 11 (refer to FIG. 5); whereby, the contents printed on the mating surfaces of the first and the second sheet portions 16 and 17 are held by the adhesive sheet 11 in a concealed state.

In the state where the information sheet 12 is stuck to the adhesive sheet 11, the adhesive layer 11B of the adhesive sheet 11 becomes in an exposed state surrounding the periphery of the information sheet 12, therefore, by attaching the adhesive layer 11B to the adherend W, the information sheet 12 is held between the adhesive sheet 11 and the adherend W to be incapable of dropping off.

Figure 6:
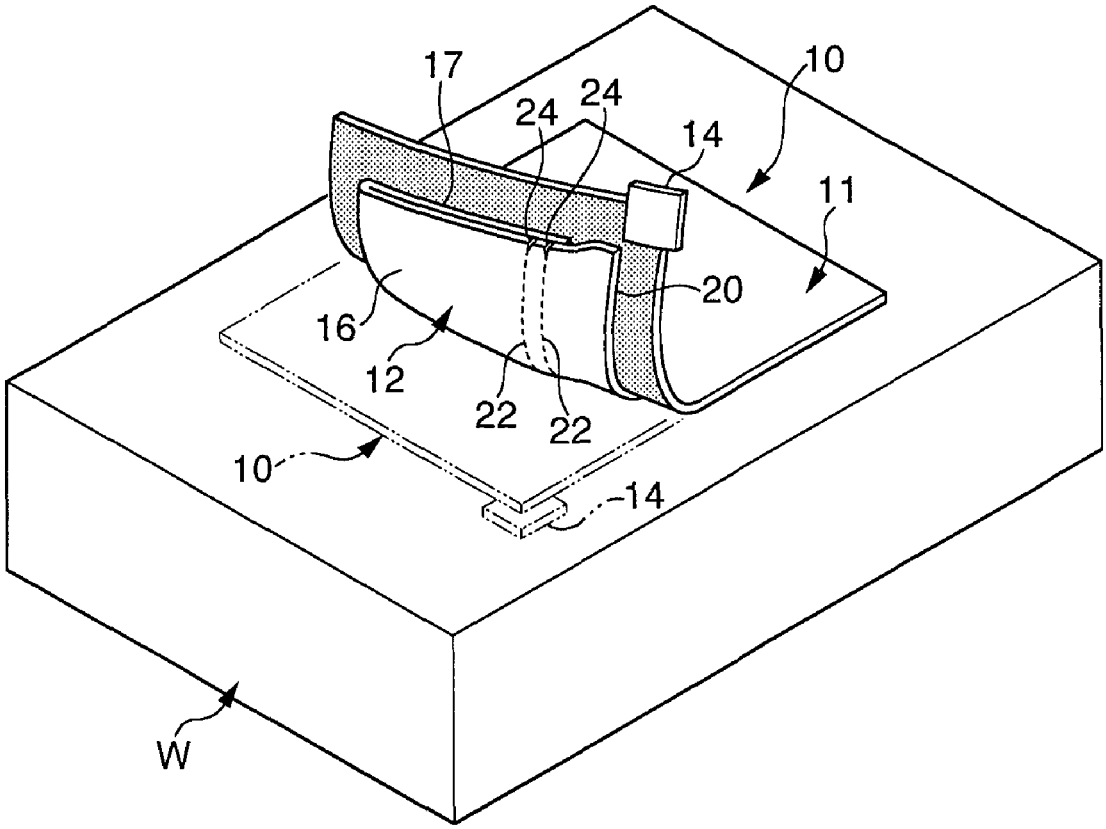
FIG. 6 is a perspective view showing a peeling state of the delivery slip which is stuck to an adherend.

As shown in FIG. 6, a recipient of a product via home-delivery can peel off the delivery slip 10 from the adherend W by picking and pulling up the picking tab 14. In so doing, the information sheet 12 is peeled off together with the adhesive sheet 11 by the adhesive layer 11B.

Figure 7:
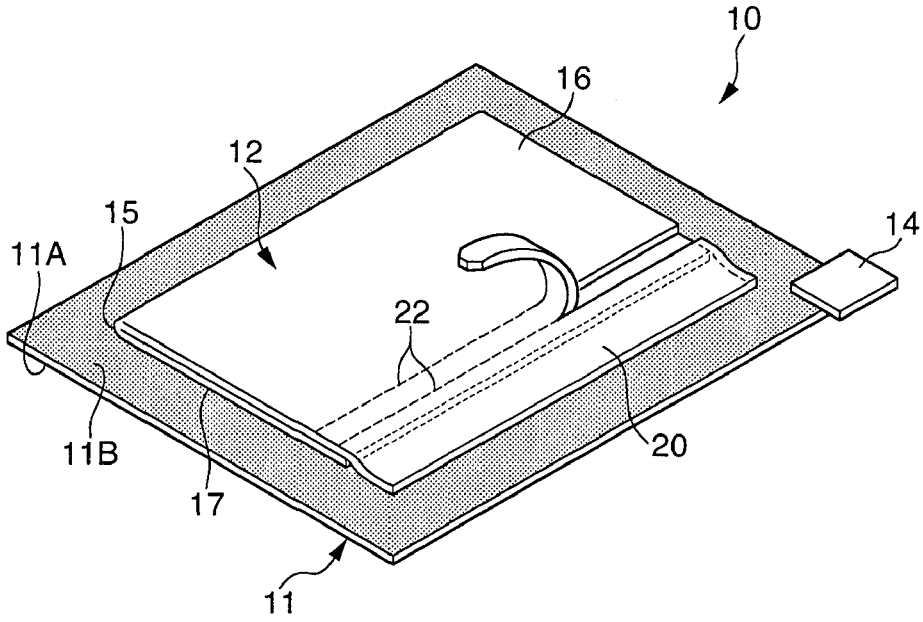
FIG. 7 is a perspective view showing a cutting-off state of a sheet portion between second perforated-lines.
Figure 8:
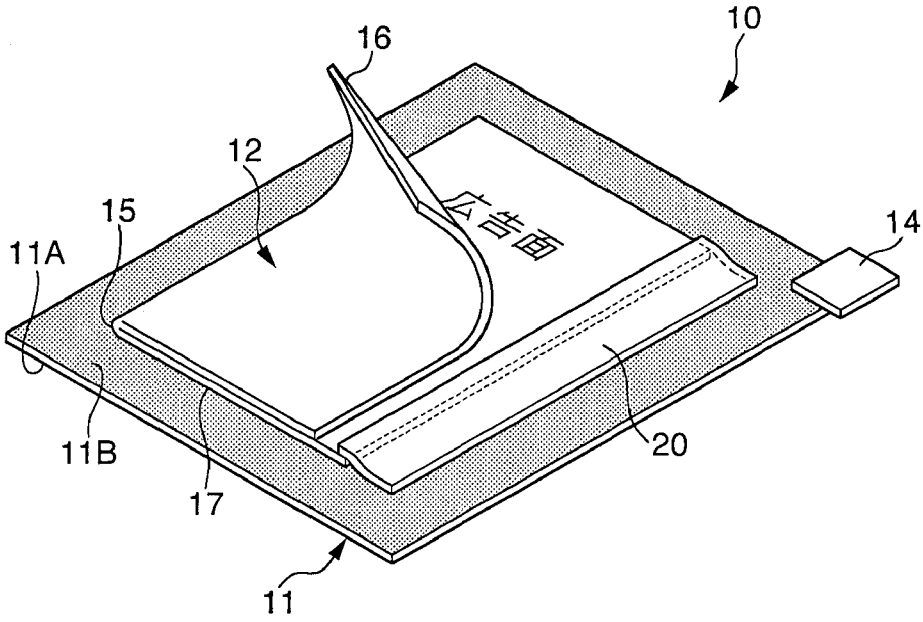
FIG. 8 is a perspective view showing a cutting-off state of the first sheet portion.

As for the delivery slip 10 after the peeling off, as shown in FIG. 7, the sheet portion can be cut off in a similar manner to a cut-tape by picking the edge border of the sheet portion between the cutout portions 24. And, after the completion of the cutting off, as shown in FIG. 8, by picking and pulling up the first sheet portion 16, a part of the first sheet portion 16 can be cut off along the first perforated-line 15 as leaving the adhesive margin 20 and the second sheet portion 17 on the adhesive sheet 11 side, whereby the printed contents become visible and capable of filing them.

Therefore, according to the embodiment as described above, such effects are obtained that the contents printed on the mating surfaces of the information sheet 12 cannot be seen externally only by peeling off the adhesive sheet 11, thereby allowing secrecy of information to be secured. Moreover, because the first sheet portion 16 is provided with the adhesive margin 20, there is no necessity to separately provide an adhesive layer on the information sheet 12, thus an inexpensive information sheet 12 can be provided.

The best arrangement, method and the like for carrying out the present invention have been disclosed so far. However, the present invention is not limited to the above.

That is, the present invention has been illustrated and described mainly about a specific embodiment. However, it is possible for those skilled in the art to add various modifications, if necessary, to the above-described embodiment with respect to the shape, position and/or disposition without departing from the technical spirit and the range of the object of the present invention.

Figure 9:
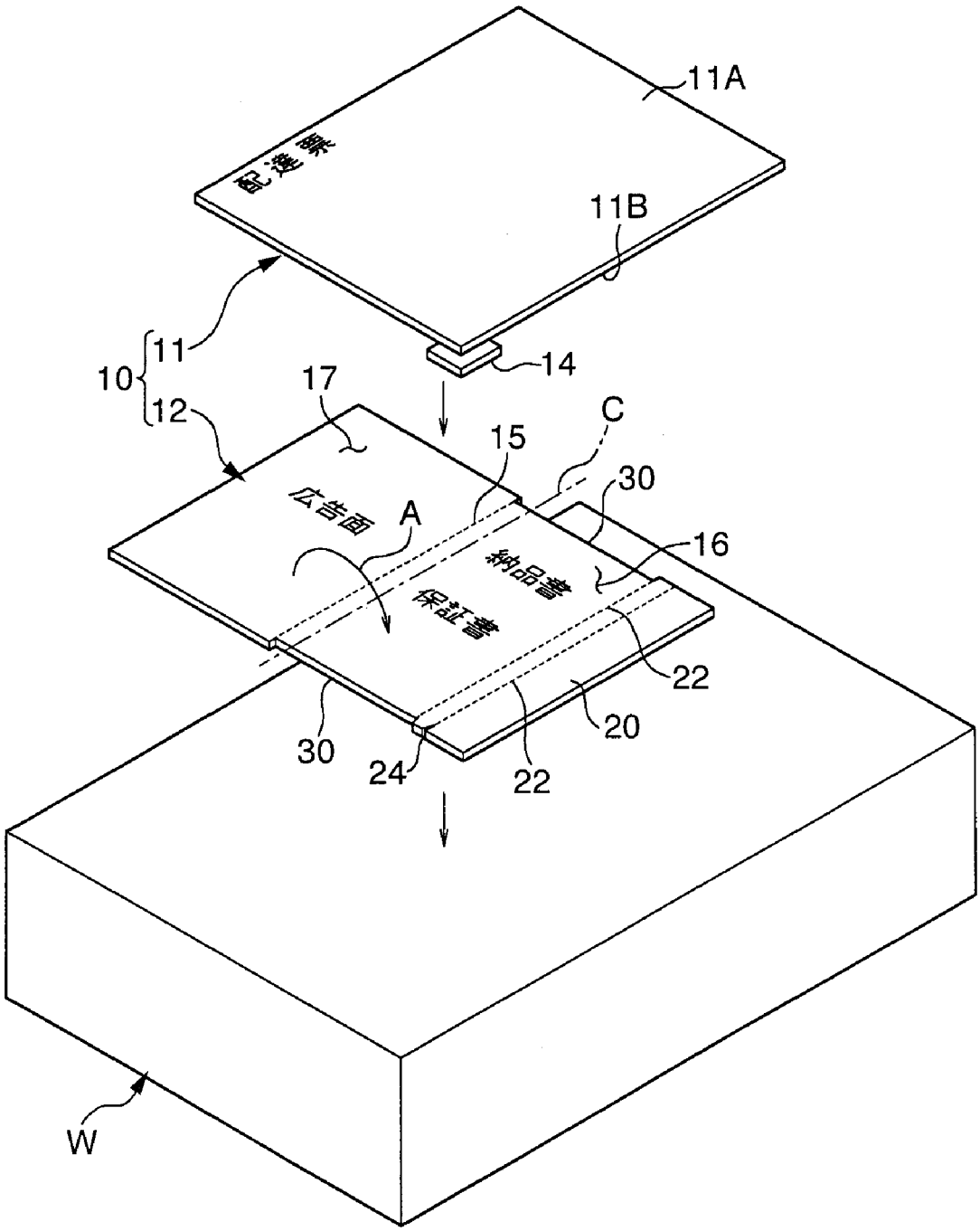
FIG. 9 is an exploded perspective view showing an information sheet according to an alternative example similar to FIG. 2.

For example, as shown in FIG. 9, the sheet portion between the first perforated-line 15 and the second perforated-lines 22 may be arranged to be provided with narrower-width portions 30 so that the first sheet portion 16 is not protruded out of the second sheet portion 17 when the information sheet 12 is folded along the first perforated-line 15. According to such an arrangement, the first sheet portion 16 can be prevented from becoming unable to be cut off caused by sticking to the adhesive layer 11B of the adhesive sheet 11.

And, the picking tab 14 is not particularly required to be provided. In this case, by arranging not to provide an adhesive layer at a corner portion in the adhesive sheet 11, essentially similar easiness of stripping-off can be obtained.

Also, in the above embodiment, a case where the information sheet 12 is folded into two has been described. However, it may be folded into three or more. In this case, by changing the folding width so that a pair of adhesive margins are formed in the folded information sheet, secrecy of information can be secured, and it becomes capable of responding to even when the information volume is increased.

Figure 10:
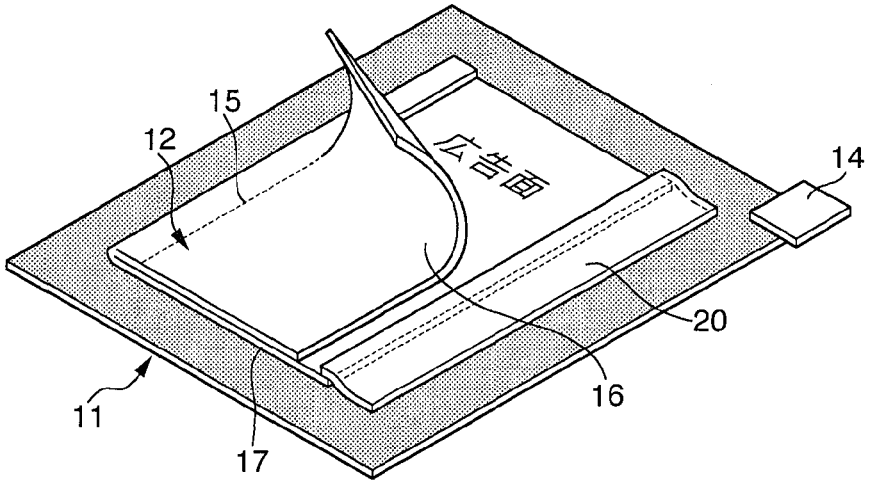
FIG. 10 is a perspective view showing an information sheet according to another alternative example of the present invention similar to FIG. 8.

Further, in the above embodiment, a case where the information sheet 12 is folded at the first perforated-line 15 has been illustrated and described. However, it is not necessarily to be folded at the first perforated-line 15. In this case, as shown in FIG. 10, the first perforated-line 15 may be arranged to be disposed on a position off the folding position to the adhesive margin 20 side within the first sheet portion 16.

Figure 11:
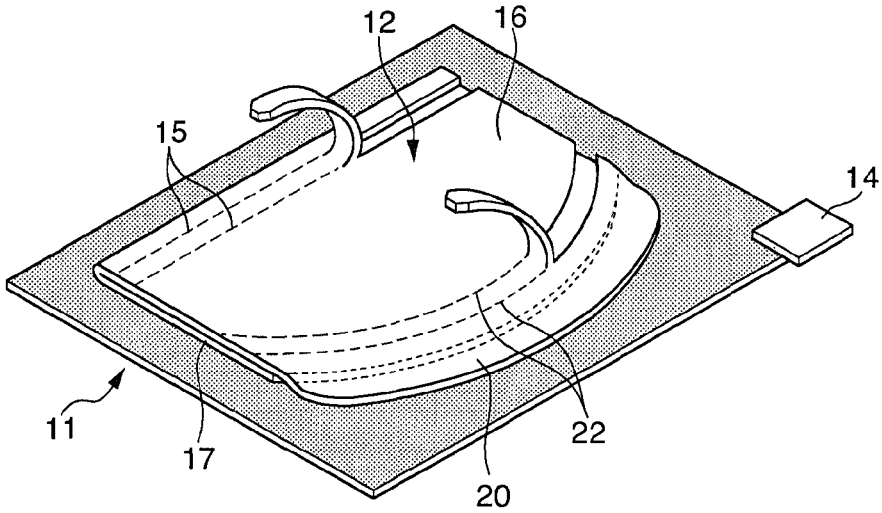
FIG. 11 is a perspective view showing an information sheet according to yet another alternative example of the present invention similar to FIG. 7.

Furthermore, as shown in FIG. 11, the first perforated-line 15 also may be formed in two rows in a substantially parallel state mutually at a predetermined interval, similarly to the second perforated-lines 22.

Still further, the planar shape of the delivery slip 10 is not limited to the illustrated arrangement example, as far as the information sheet 12 is arranged to be stuck within the surface of the adhesive sheet 11 so that the adhesive sheet 11 can be stuck to the adherend W.

Still furthermore, the shape of the information sheet 12 is also not limited to the illustrated arrangement example, and other shapes such as a round shape, an elliptical shape, and a polygonal shape may be adopted. Even in such a case, as shown in FIG. 11, it is allowable as long as the edge portion side of the first sheet portion 16 is protruded a predetermined amount out of the edge border of the second sheet portion 17 to form the adhesive margin 20, and the second perforated-lines 22 are formed along the edge border of the second sheet portion 17.

Yet still further, the information sheet 12 may be applied, not limited to the case of applying to the delivery slip 10, but also to other cases, for example, a label and the like in which an information sheet printed with application guidelines for giveaway prizes and the like is to be held between a product and the label.

Yet still furthermore, the cutting-off facilitating portion may be arranged by forming incisions of a predetermined length respectively instead of the cutout portions 24.

Yet more still further, the first and the second perforated-lines 15 and 22 are formed by holes, slits, and the like which penetrate the information sheet 12 continuously at a predetermined interval, and not particularly limited to about the diameter, the width, the length, the shape, the interval, the direction of the slits, and the like.

Yet more still furthermore, it may be arranged that a layer which functions as a receipt by a pseudo-adhesive and the like is formed on the adhesive sheet 11 so that a delivery person receives a proof such as a receipt stamp from a recipient.

What is claimed is:

1. A delivery slip, comprising:

an adhesive sheet; and an information sheet stuck to the adhesive sheet and located between the adhesive sheet and an adherend, the information sheet being exposed when the adhesive sheet is peeled off from the adherend, wherein a position a predetermined distance off the center of the information sheet is set as a folding position so as to form a first and a second information sheet portions partitioned by the folding position; and when the first sheet portion is folded and overlapped with the second sheet portion at the folding position, an edge portion side of the first sheet portion protrudes a predetermined amount from an edge border of the second sheet portion;

and only the edge portion side of the first sheet portion and a contra mating surface of the second sheet portion are designed to stick to the adhesive sheet.

2. A delivery slip, comprising:

an adhesive sheet; and an information sheet stuck to the adhesive sheet and located between the adhesive sheet and an adherend, the information sheet being exposed when the adhesive sheet is peeled off from the adherend, wherein a first perforated-line is formed at a position a predetermined distance off the center of the information sheet so as to form a first and a second information sheet portions partitioned by the first perforated-line; and when the first sheet portion is folded and overlapped with the second sheet portion along the first perforated-line, an edge portion side of the first sheet portion is protruded a predetermined amount out from an edge border of the second sheet portion; and only the edge portion side of the first sheet portion and a contra mating surface of the second sheet portion are designed to stick to the adhesive sheet.

3. The delivery slip according to claim 1, wherein a first perforated-line is formed in the first sheet portion or at the folding position, and a second perforated-line is formed in the first sheet portion, so that the first sheet portion between the first perforated-line and the second perforated-line is formed to be capable of being cut off.

4. The delivery slip according to claim 3, wherein a sheet portion between the first perforated-line and the second perforated-line is provided with narrower-width portions so that the first sheet portion is not protruded out of the second sheet portion when the sheet is folded at the folding position.

5. The delivery slip according to claim 3, wherein the first perforated-line and/or the second perforated-line is formed in substantially parallel two rows mutually, and a cutting-off facilitating portion for the sheet portion between the two-row perforated-lines is formed at each edge portion of these perforated-lines.

6. The delivery slip according to claim 3, wherein at least one surface of mating surfaces of the first sheet portion and the second sheet portion and a contra mating surface of the first sheet portion may be formed as a printing surface.

7. The delivery slip according to claim 2, wherein the first perforated-line is formed in the first sheet portion or at a folding position, and a second perforated-line is formed in the first sheet portion, so that the first sheet portion between the first perforated-line and the second perforated-line is formed to be capable of being cut off.

8. The delivery slip according to claim 7, wherein a sheet portion between the first perforated-line and the second perforated-line is provided with narrower-width portions so that the first sheet portion is not protruded out of the second sheet portion when the sheet is folded at the folding position.

9. The delivery slip according to claim 7, wherein the first perforated-line and/or the second perforated-line is formed in substantially parallel two rows mutually, and a cutting-off facilitating portion for the sheet portion between the two-row perforated-lines is formed at each edge portion of these perforated-lines.

10. The delivery slip according to claim 7, wherein at least one surface of mating surfaces of the first sheet portion and the second sheet portion and a contra mating surface of the first sheet portion may be formed as a printing surface.

* * * * *